US006582106B2

(12) United States Patent
Jamison

(10) Patent No.: US 6,582,106 B2
(45) Date of Patent: Jun. 24, 2003

(54) LIGHTING FIXTURE CLAMPING MEMBER

(75) Inventor: William H. Jamison, Covington, VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/988,802

(22) Filed: Nov. 20, 2001

(65) Prior Publication Data

US 2003/0095413 A1 May 22, 2003

(51) Int. Cl.[7] ..... F21V 21/00

(52) U.S. Cl. ..... 362/396; 362/364; 362/365; 362/366; 362/147; 362/404; 362/457; 362/368; 362/374; 248/205.2; 248/344

(58) Field of Search ..... 362/396, 364, 362/365, 366, 404, 147, 457, 368, 374; 248/205.2, 344

(56) References Cited

U.S. PATENT DOCUMENTS

| | | | |
|---|---|---|---|
| 4,274,615 A | | 6/1981 | Chan et al. |
| 4,327,403 A | | 4/1982 | Capostagno et al. |
| 4,459,648 A | | 7/1984 | Ullman |
| 4,520,436 A | | 5/1985 | McNair et al. |
| 4,763,231 A | | 8/1988 | Houplain |
| 4,829,410 A | | 5/1989 | Patel |
| 5,045,984 A | | 9/1991 | Trowbridge et al. |
| 5,050,052 A | * | 9/1991 | Wade ..... 362/101 |
| 5,758,959 A | | 6/1998 | Sieczkowski |
| 5,836,677 A | | 11/1998 | Connors et al. |
| 6,000,818 A | | 12/1999 | Caluori |
| 6,089,732 A | | 7/2000 | Wright et al. |

FOREIGN PATENT DOCUMENTS

| | | |
|---|---|---|
| DE | 1118115 | 11/1961 |

* cited by examiner

*Primary Examiner*—Sandra O'Shea
*Assistant Examiner*—Mark Tsidulko
(74) *Attorney, Agent, or Firm*—Tara L. Hoffman; Alfred N. Goodman; Mark S. Hicks

(57) ABSTRACT

A clamping member for a lighting fixture, includes first and second parts. The first part has a receiving portion and a first clamping portion extending therefrom that has opposing first and second surfaces. The second part is separable from the first part, and has a main portion and a second clamping portion extending from the main portion. The second clamping portion has first and second opposing surfaces. The main portion is received in the receiving portion of the first part forming a friction fit so that a support receiving area is defined between the second surface of the first clamping portion and the first surface of the second clamping portion. A fastener is disposed on the second surface of the second clamping portion for engaging the lighting fixture.

23 Claims, 5 Drawing Sheets

LIGHTING FIXTURE CLAMPING MEMBER

FIELD OF THE INVENTION

The present invention relates to a lighting fixture having clamping members for supporting the lighting fixture in a recessed mounting. Specifically, the clamping members allow both a toolless installation of the lighting fixture and interchangeability of components of the lighting fixture including the reflector, shield member, and trim.

BACKGROUND OF THE INVENTION

Conventional recessed lighting fixtures include a reflector or trim and shield member supported on a plaster frame with a lamp assembly mounted to either the reflector or the shield member. An aesthetic trim or reflector is often provided below the ceiling. Recessed lighting fixtures are typically mounted between joists above an aperture of a ceiling by hanger bars connected to the plaster frame.

Installation of conventional recessed lighting fixtures often require the installer to mount the lighting fixture prior to installation of the ceiling. Similarly, replacement of the lighting fixture must be done from above the ceiling. Additionally, installation requires tools to secure the hanger bars to the joist supports and/or to secure the fixture to the ceiling.

Examples of conventional recessed lighting fixtures include U.S. Pat. No. 6,089,732 to Wright et al.; U.S. Pat. No. 6,000,818 to Caluori; U.S. Pat. No. 5,758,959 to Sieczkowski; U.S. Pat. No. 4,829,410 to Patel; U.S. Pat. No. 4,763,231 to Houplain; U.S. Pat. No. 4,520,436 to McNair et al.; U.S. Pat. No. 4,459,648 to Ullman; U.S. Pat. No. 4,327,403 to Capostagno et al.; and U.S. Pat. No. 4,274,615 to Chan et al.

SUMMARY OF THE INVENTION

Accordingly, an object of the present invention is to provide a lighting fixture with clamping members that allow easy installation in a support structure, such as a ceiling, via a recessed mounting from below the ceiling.

Another object of the present invention is to provide a lighting fixture with clamping members used to mount the lighting fixture without the use of tools.

Yet another object of the invention is to provide a lighting fixture with clamping members that allow interchangeability of the lighting fixture components from below or inside the support.

Still another object of the present invention is to provide interchangeability of lighting fixtures using the same clamping members of the invention.

The foregoing objects are basically attained by a clamping member for a lighting fixture, comprising a first part that has a receiving portion and a first clamping portion extending therefrom that has opposing first and second surfaces, and a second part, separable from the first part, that has a main portion and a second clamping portion extending from the main portion. The second clamping portion has first and second opposing surfaces. The main portion is received in the receiving portion of the first part forming a friction fit therebetween so that a support receiving area is defined between the second surface of the first clamping portion and the first surface of the second clamping portion. A fastener is disposed on the second surface of the second clamping portion for engaging the lighting fixture.

The foregoing objects are also attained by a lighting fixture, comprising a support structure that has opposing first and second surfaces, a lamp enclosure that receives a lamp assembly, and a mounting member that supports the lamp enclosure and has a first fastener. A clamping member engages each of the support structure and the mounting member, respectively. The clamping member has first and second parts. The first part is located proximate the first surface of the support structure. The second part is located proximate the second surface of the support structure, and includes a second fastener releasably coupled to the first fastener of the mounting member. The second part is located between the support structure and the second fastener.

The foregoing objects are also attained by a method of mounting a lighting fixture to a support structure. The support structure has an opening and first and second opposing surfaces. The method comprises the steps of mounting a clamping member on the support structure at the opening of the support structure with a first part of the clamping member engaging the first surface of the support structure and the second part of the clamping member engaging the second surface, and coupling a mounting member with the second part of the clamping member at a plane not toward the first surface of the support structure. The mounting member supports a lamp enclosure that receives a lamp assembly.

Other objects, advantages and salient features of the invention will become apparent from the following detailed description, which, taken in conjunction with annexed drawings, discloses the preferred embodiments of the present invention.

BRIEF DESCRIPTION OF THE DRAWINGS

Referring to the drawings which form a part of this disclosure.

DETAILED DESCRIPTION OF THE INVENTION

Figure 1:
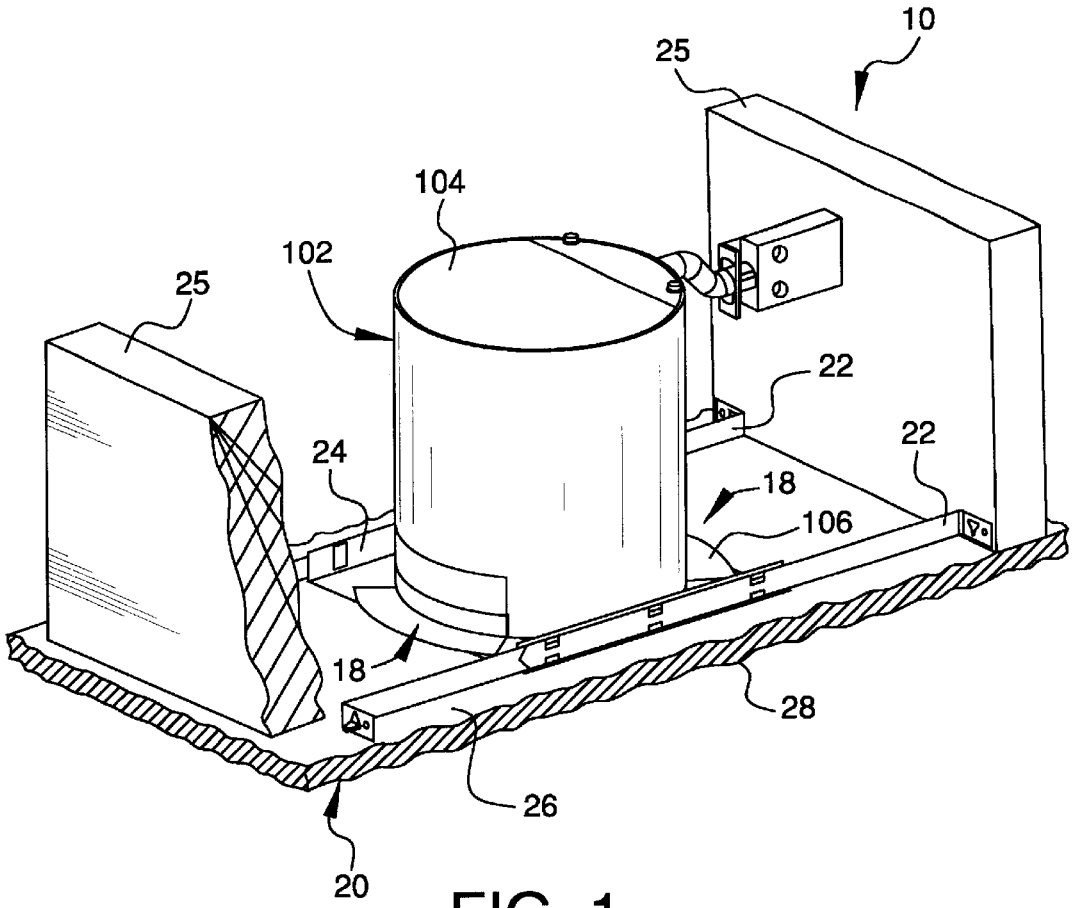
FIG. 1 is perspective view of a lighting fixture in accordance with a first embodiment of the present invention, showing clamping members supporting the lighting fixture with respect to a support structure.

Referring to FIGS. 1–8, a lighting fixture 10 in accordance with a first embodiment of the present invention generally includes a lamp enclosure 12 that receives a lamp assembly 14 and is supported by a mounting member 16. Clamping members 18 mounted to a support structure 20, such as a ceiling, releasably engage mounting member 16, thereby supporting mounting member 16 and lamp enclosure 12 with respect to support structure 20. Clamping members 18 allow engagement of various configurations of lamp enclosure 12 via mounting member 16, so that any selected configuration of lamp enclosure 12 can be installed onto support structure 20. Also, because clamping members 18 releasably engage mounting member 16, mounting member 16 and lamp enclosure 12 can be easily removed from support structure 20 and replaced. Additionally, clamping members 18 are designed so that no tools are required to install mounting member 16 and lamp enclosure 12 onto support structure 20.

Lighting fixture 10 is preferably a recessed downlight installed into a ceiling; however, fixture 10 can be any type of known lighting fixture. Although, support structure 20 is preferably a ceiling, support structure 20 can be any wall or floor. As seen in FIG. 1, hanger bars 22 and a plaster frame 24 can be used to provide support to lighting fixture 10 between two supports, such as joists 25, as is well known in the art, in addition to the support provided by clamping members 18. However, hanger bars 22 and plaster frame 24 are not required because clamping members 18 alone can support fixture 10 with respect to support structure 20.

Figure 2:
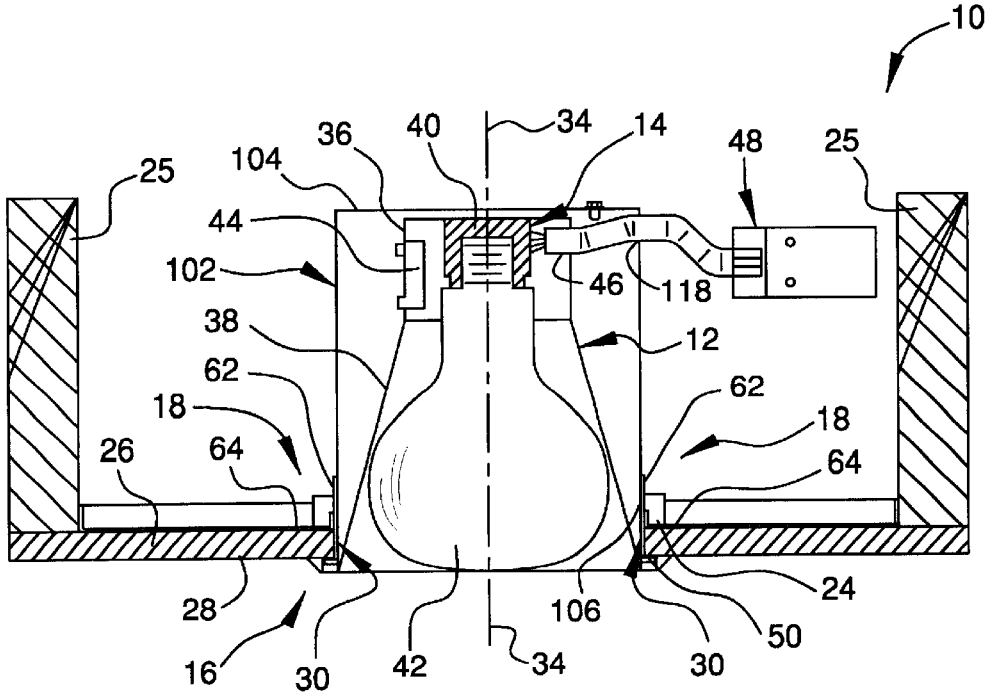
FIG. 2 is a side elevational view in section of the lighting fixture illustrated in FIG. 1.
Figure 3:
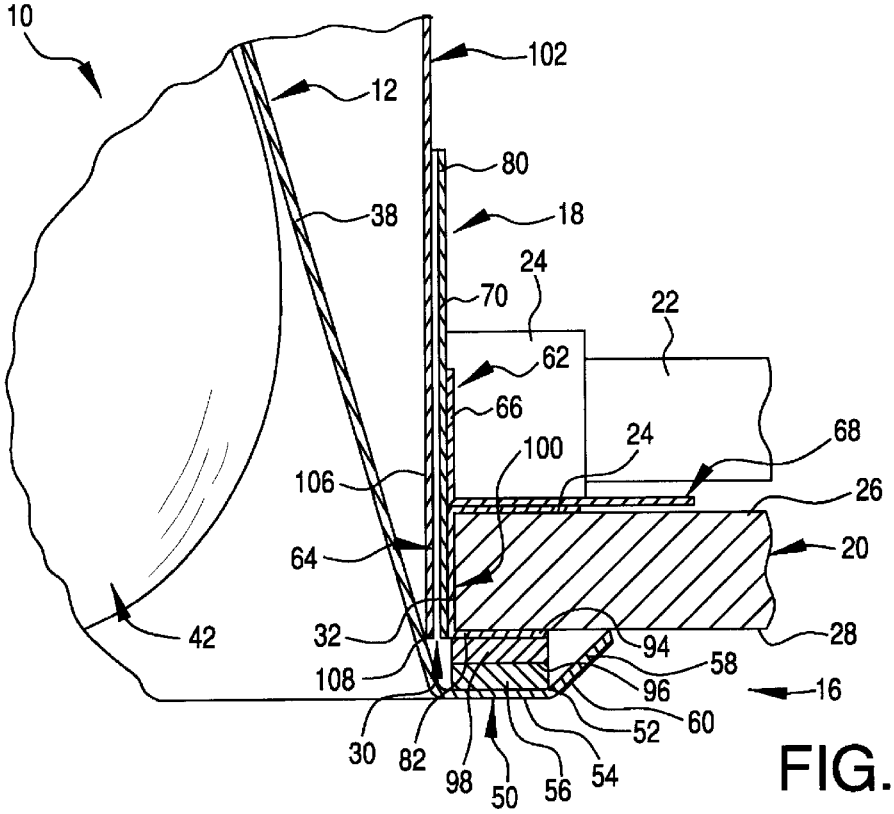
FIG. 3 is an enlarged, partial side elevational view in section of the lighting fixture illustrated in FIG. 1, showing a lamp enclosure of the lighting fixture mounted to a clamping member.
Figure 4:
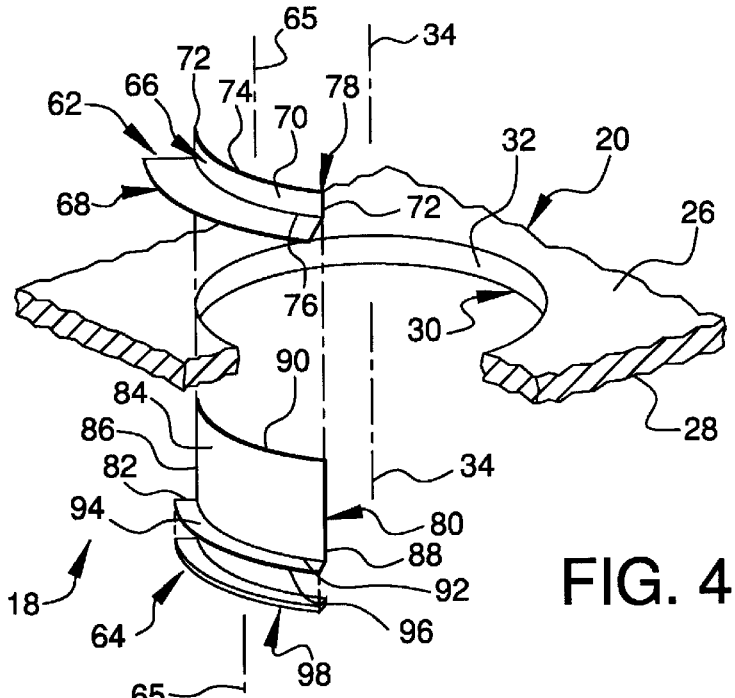
FIG. 4 is an exploded, perspective view of the clamping member of the lighting fixture illustrated in FIG. 1, showing first and second parts of the clamping member being mounted to the support structure.

Support structure 20 includes a first or upper surface 26 and an opposite second or lower surface 28 with an opening 30 extending from upper surface 26 to lower surface 28. Opening 30 is sized to receive lighting fixture 10 and defines a perimeter surface 32 extending around an axis 34 extending through the center of opening 30, as best seen in FIGS. 2 and 4. Plaster frame 24 is disposed on support structure upper surface 26 and surrounds opening 30 with a portion extending into opening 30 along perimeter surface 32. Plaster frame 24 provides additional support to lighting fixture 30 but is not required. The terms "upper" and "lower" are used only to facilitate description of the claimed invention and do not limit the orientation of support structure 20 or lighting fixture 10, as seen in FIGS. 1 and 3. For example, first and second support surfaces 26 and 28 can be lower or upper surfaces, or left or right surfaces, etc., depending on the orientation of lighting fixture 10 desired, i.e. in a ceiling, an upstanding wall, or floor.

Lamp enclosure 12 of lighting fixture 10 is a reflective member or a non-reflective trim member, and includes first and second end portions 36 and 38. Lamp assembly 14 is received within lamp enclosure 12, as best seen in FIG. 2, and includes a socket 40 with a lamp 42 having an end received in socket 40. Socket 40 is coupled to first end portion 36 of lamp enclosure 12 with lamp 42 extending therefrom toward second end portion 38 of lamp enclosure 12. Also, at first end 36 of lamp enclosure 12 is a thermal sensor 44 for detecting over heating and an inlet 46 for receiving wire conduit of an electrical connector 48 for providing power to lamp assembly 14. Preferably, electrical connector 48 is a modular or cross-over connector such as that disclosed in co-pending, commonly assigned U.S. patent application Ser. No. 09/862,706 to William H. Jamison entitled Adjustable Conduit Connector, the subject matter of which is hereby incorporated by reference. However, electrical connector 48 can be any known electrical connector, such as a standard junction box. Lamp enclosure 12 is generally cone shaped and preferably made of a reflective material to reflect the light of lamp 42, as is well known in the art. Lamp enclosure 12 can also be a trim or non-reflective member. Second end portion 38 of lamp enclosure 12 is open to allow light from lamp 42 to radiate through and also to facilitate replacement of lamp 12 from below support structure 20 through second end portion 38.

Mounting member 16 of lighting fixture 10 includes a radial mounting flange 50 extending from second or open end portion 38 of lamp enclosure 12. Preferably, lamp enclosure 12 and mounting member 16 form a one-piece unitary member, as seen in FIGS. 2 and 3, but can be formed separately and attached either fixedly or releasably as long as mounting member 16 supports lamp enclosure 12 with respect to support surface 20. Flange 50 has first and second opposing surfaces 52 and 54 with a fastener 56 disposed on first surface 52 in the form of a ring. A trim wall 58 extends outwardly from the outer perimeter 60 of flange 50 at an angle, thereby forming an obtuse angle between trim wall 58 and first surface 52 of flange 50, as seen in FIG. 3. Trim wall 58 can also extend from flange 50 at no angle. Flange 50 can be provided with a lens.

Figure 5:
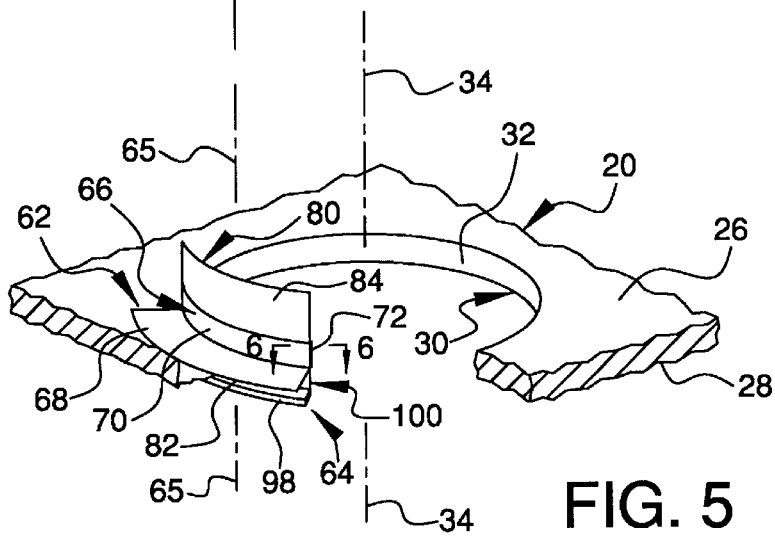
FIG. 5 is a perspective view of the clamping member illustrated in FIG. 4, showing the first and second parts of the clamping member engaged and mounted onto the support structure.
Figure 6:
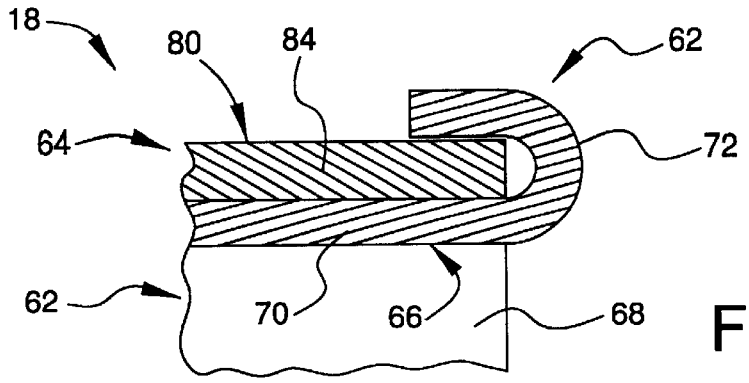
FIG. 6 is a partial top plan view in section of the clamping member taken along lines 6—6 of FIG. 5, showing the engagement of the first and second parts of the clamping member.
Figure 7:
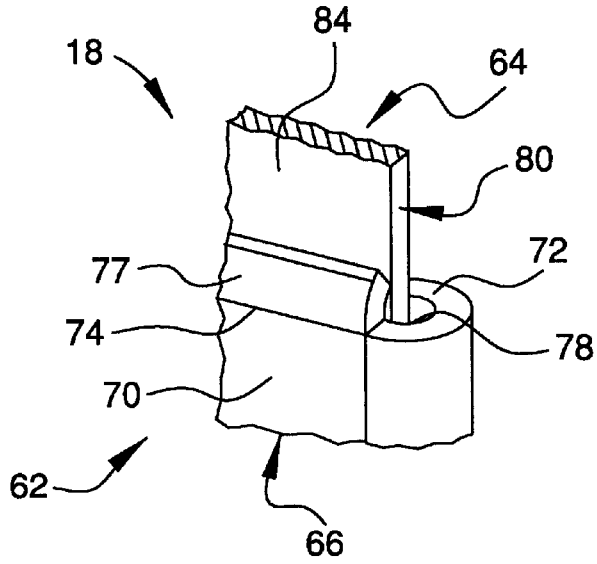
FIG. 7 is a partial, perspective view of the clamping member illustrated in FIG. 5, showing the engagement of the first and second parts of the clamping member.

Each clamping member 18 of lighting fixture 10, generally includes first and second parts 62 and 64, as best seen in FIGS. 4–6, each of which extend along an arc centered about axis 34 for about 70 degrees. Since clamping members 18 are the same, only one will be described. First part 62 includes a receiving portion 66 and a clamping portion 68 extending therefrom at a substantially ninety degree angle. Receiving portion 66 includes a wall 70 that has opposing U-shaped ends 72 (only one U-shaped end shown in FIG. 6) and top and bottom edges 74 and 76 extending therebetween, as seen in FIG. 4. Extending from top edge 74 is a curved extension 77, as best seen in FIG. 7, for engaging second part 64 and creating a friction fit therebetween. Curved extension 77 curves toward each U-shaped end 72. A slot 78 is defined between U-shaped ends 72 and wall 70, as best seen in FIG. 6. Clamping portion 68 is substantially planar and extends from bottom edge 76 of wall 70. Although it is preferable to have a friction fit between first and second parts 62 and 64, any known attachment can be used, such as adhesive.

Second part 64 of clamping member 18 includes a main portion 80 and a clamping portion 82 extending therefrom at a substantially ninety degree angle. Main portion 80 includes a wall 84. Wall 84 includes opposing end edges 86 and 88 and top and bottom edges 90 and 92 extending therebetween, as seen in FIG. 4. Clamping portion 68 extends from bottom edge 92 of wall 84 and includes first and second surfaces 94 and 96.

Wall 84 of second part 64 has a greater vertical length than the wall 70 of the first part 62 with the length of wall 84 being defined between its top and bottom edges 90 and 92 and with the length of wall 70 of first part 62 being defined between its top and bottom edges 74 and 76. However, the lengths of walls 84 and 70 can be the same or the length of wall 70 of first portion 62 can be larger than the length of wall 84 of second portion 64. The length of wall 84 of second part 64 provides adjustability for clamping member 18 to accommodate various ceiling heights.

First and second parts 62 and 64 of clamping member 18 are curved to accommodate support structure opening 30. In particular, receiving portion 66 and clamping portion 68 of first part 62 and main portion 80 and clamping portion 82 of second part 64 are each curved about a longitudinal axis 65 of clamping member 18 and/or central axis 34 of opening 30 and conform to opening perimeter surface 32, as best seen in FIGS. 4–5. Also, although two clamping members 18 are shown, more than two or only one clamping member 18 can be employed and with different arc lengths.

A fastener 98 is disposed on second surface 96 of clamping portion 82 of second part 64 for mating with fastener 56 of mounting member 16, as best seen in FIGS. 3–5. Fastener 98 covers substantially the entire second surface 96. Fasteners 56 and 98 are preferably made of hook and loop material. However, fasteners 56 and 98 can be any known attachment such as adhesive, snapping members, and the like.

Receiving portion 66 of first part 62, specifically slot 78, slidably receives main portion 80, specifically wall 84, thereby defining a support receiving area 100 between clamping portions 68 and 82 of each of first and second parts 62 and 64, respectively, as seen in FIGS. 3 and 5. Preferably, slot 78 and wall 84 are adapted to create a frictional engagement therebetween, thereby holding first and second parts 62 and 64 in engagement. In particular, the width and thickness of each wall 84 and 70 along with curved extension 77 provide a friction fit between wall 84 of second part 64 and wall 70 with U-shaped ends 72 of first part 62, as seen in FIG. 6 (showing only one U-shaped end). Curved extension 77 forces wall 84 of second part 64 toward each U-shaped end 72, as seen in FIG. 7 (showing only one end), thereby creating an interference fit between wall 84 and U-shaped ends 72. Also, clamping portion 68 of first part 62 extends further out radially from wall 70 than clamping portion 82 of second part 64 from wall 84, as seen in FIG. 3; however, these portions 68 and 82 can extend the same distance, or clamping portion 82 of second part 64 can extend further than clamping portion 68 of first part 62. An additional attachment, such as adhesive or screws, can be employed to maintain the engagement between first and second parts 62 and 64.

Figure 8:
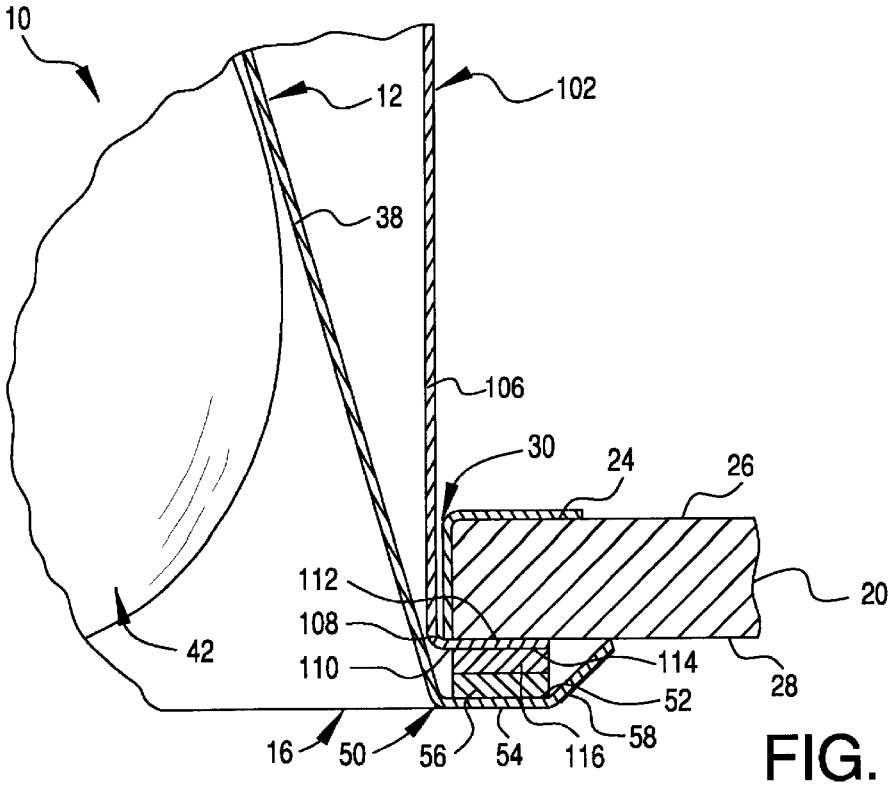
FIG. 8 is an enlarged, partial front elevational view in section of the lighting fixture illustrated in FIG. 1, showing the lamp enclosure coupled to a shield member of the lighting fixture and rotation approximately 90° from FIG. 3.

As seen in FIGS. 1–3 and 8, a shield member 102 can be used to cover lamp enclosure 12 for shielding the surrounding insulation from the heat of lighting fixture 10, as is well known in the art. However, shield member 102 is not required. Shield member 102 is a standard can with a closed end 104 and an opposite open end 106 defined by a perimeter edge 108 and corresponding to open end 38 of lamp enclosure 12. Ears 110 extend radially outwardly from perimeter edge 108 of shield member 102, as seen in FIG. 8 (showing one ear), for engaging mounting member 12. In particular, each ear 110 includes first and second planar surfaces 112 and 114 with a fastener 116 being disposed on second surface 114 for engaging fastener 56 of mounting member 12, as seen in FIG. 8. Fastener 116 is preferably hook and loop material for engaging the hook and loop material of fastener 56. However, any known attachment can be used such as adhesive, snapping members, or the like. Two ears 110, each extending along an arc of about 70 degrees centered on axis 34 are preferably used with shield member 102, however, more than two or only one ear 1 10 can also be used. Shield member 102 also includes an inlet 118 that is generally aligned with inlet 46 for receiving wire conduit of electrical connector 48.

Assembly of Embodiment of FIGS. 1–8

In general, assembly and installation of lighting fixture 10 requires mounting clamping members 18 to support structure 20 and coupling mounting member 16, which supports lamp enclosure 12, with clamping members 18.

Clamping members 18 are mounted to perimeter surface 32 of support structure opening 30 and are preferably generally axially aligned and located on diametrically opposite sides of opening central axis 34. However, clamping members 18 can be placed anywhere along perimeter surface 32.

Mounting of clamping members 18 to support structure 20 at opening 30 can be accomplished one of two ways. Since clamping members 18 are the same, the mounting of only one clamping member 18 will be described. The first way is to insert wall 84 of clamping member second part 64 into slot 78 of clamping member first part 62 so that support receiving area 100 between clamping portions 68 and 82 is wider than the thickness of support structure 20. The assembled first and second parts 62 and 64 can then be mounted onto support structure 20 at opening 30 so that support structure 20 is received in support receiving area 100 between clamping portions 68 and 82. Wall 84 of second part 64 can then be further inserted through slot 78 of first part 62 until a tight fit is formed between first and second parts 62 and 64 and support structure 20. Clamping member 18 is adjustable to differing thickness of various support structures by sliding wall 84 with respect to slot 78 to adjust support receiving area 100 to the thickness of the particular support structure. The friction fit between wall 84 and receiving portion 66 maintains the engagement between first and second parts 62 and 64. Plaster frame 24 is located between upper surface 26 of support structure 20 and clamping portion 68 of first part 62, as seen in FIG. 3. However, plaster frame 24 is not required.

The second way of mounting clamping member 18 to support structure 20 is to initially place clamping member first part 62 onto support structure 20 at opening 30 so clamping portion 68 rests on upper surface 26 of support structure 20. Wall 84 of clamping member second part 64 can then inserted through opening 30 and into slot 78 of first part 62.

Once clamping members 18 are mounted to support structure 20, lamp enclosure 12 with socket 40 secured to first end 36, is inserted through opening 30 until fastener 56 of mounting member 16 abuts and engages fastener 98 of clamping member 18. Fastener 56 engages fastener 98 at a plane not toward or facing away from the second or lower surface 28 of support structure 20, as best seen in FIG. 3. In other words, fastener 56 engages fastener 98 below support structure 20 and outside of opening 30. The term "below" is used only to describe the relative orientation of fastener 56 with respect to support structure 20 such that fastener 56 can be above or to the side of support structure 20. Additionally, because mounting flange 50 and trim wall 58 have a diameter larger than opening 30, mounting member 16 can abut lower surface 28 of support structure 20. Trim wall 58 covers the outer perimeter of opening 30 to provide an aesthetic trim to lighting fixture 10. The engagement of fasteners 56 and 98 supports lamp enclosure 12 with respect to support structure 20. Once lamp enclosure 12 is mounted, electrical connector 48 can then be connected to socket 40 through inlet 46 of lamp enclosure 12. Alternatively, the electrical connections can be made prior to the mounting of lamp enclosure 12.

In this position, support structure 20 is received between clamping portions 68 and 82 of first and second clamping parts 62 and 64, respectively, with opening perimeter surface 32 abutting wall 84 of second part 64. First surface 94 of clamping portion 82 abuts lower surface 28 of support structure 20 with fastener 98 of clamping portion 82 extending from second surface 96 opposite support structure 20 and engaging fastener 56 of mounting member 16.

Since fastener 56 extends around mounting flange 50, fastener 98 of each clamping member 18 engages only a portion of fastener 56 leaving portions of fastener 56 unused. Additional clamping members can be added which engage the unused portions of 56.

Alternatively, shield member 102 can be coupled to the portions of fastener 56 that will not be engaged by clamping members 18. Specifically, prior to mounting lamp enclosure 12 onto support structure 20 via clamping members 18, shield member 102 is mounted onto mounting member 16 by engaging fastener 116 of ears 110 with fastener 56 so that shield member covers lamp enclosure 12. The assembly of shield member 102, mounting member 16, and lamp enclosure 12 is then inserted through opening 30 of support structure 20 until fastener 56 engages fastener 98 of clamping members 18, in the same manner as described above. Fastener. 98 of clamping members 18 engages different, circumferentially offset portions of fastener 56 of mounting member 16 than that of fastener 116 of shield member ears 110. For example, the engagement of mounting member fastener 56 and fastener 98 of each clamping member 18 can be located at 0-degrees and 180-degrees, respectively, of support structure opening 30 and the engagement of fastener 56 of mounting member 16 with each fastener 116 of shield member ears 110 can be located at 90-degrees and 270-degrees, respectively, of opening 30.

In this mounted position, first surface 112 of each ear 110 abuts lower surface 28 of support structure 20 with fastener 116 extending from second surface 114 of each ear 11 engaging fastener 56 of mounting member 16, as best seen in FIG. 7 (showing one ear). Perimeter edge 108 is located near second end 38 of lamp enclosure and either abuts or is slightly spaced from the outer surface of lamp enclosure 12. Trim wall 58 covers the outer perimeter of opening 30 of support structure.

Figure 9:
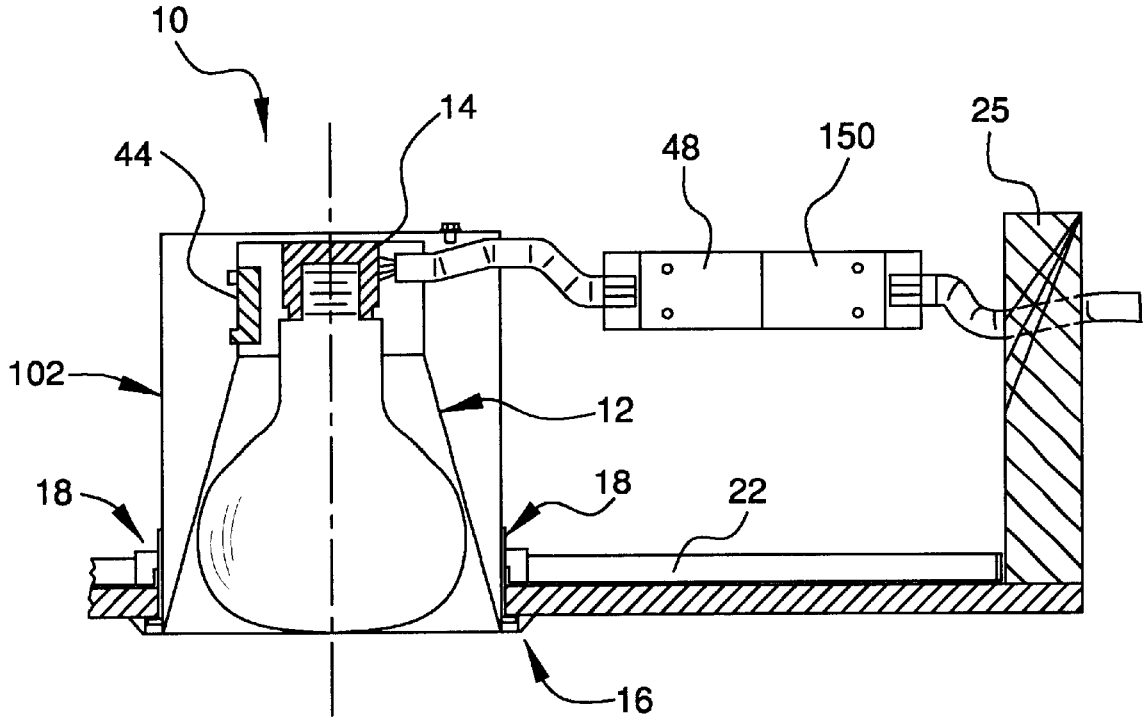
FIG. 9 is an enlarged, partial side elevational view in section of a lighting fixture in accordance with a second embodiment of the present invention, showing two electrical connectors providing power to the lighting fixture.

Embodiment of FIG. 9

Referring to FIG. 9, electrical connector 48 of lighting fixture 10 can be connected to a second substantially identical connector 150 to provide power to fixture 10. In particular, electrical connectors 48 and 150 plug into one another in a conventional manner providing power to fixture 10 and eliminating the need for a junction box. Connector 150 is connected to a power source and connector 48 is electrically connected to lamp assembly 14. The assembly of connectors 48 and 150 can be located between joist 25 and fixture 10, as seen in FIG. 9, or above or behind fixture 10.

Figure 10:
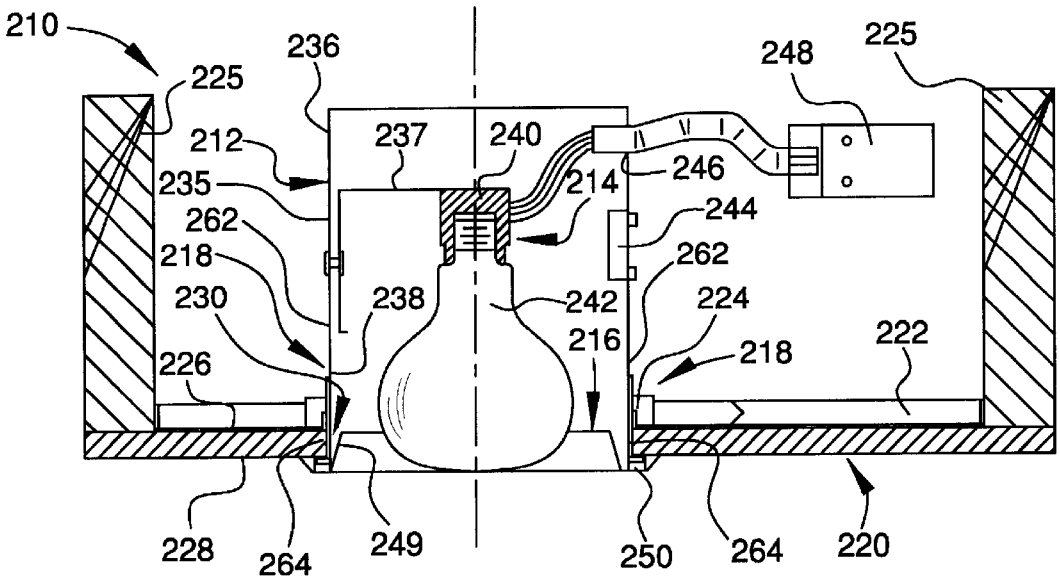
FIG. 10 is a side elevational view in section of a lighting fixture in accordance with a third embodiment of the present invention, showing the lighting fixture partially and supported by clamping members with respect to a support structure.
Figure 11:
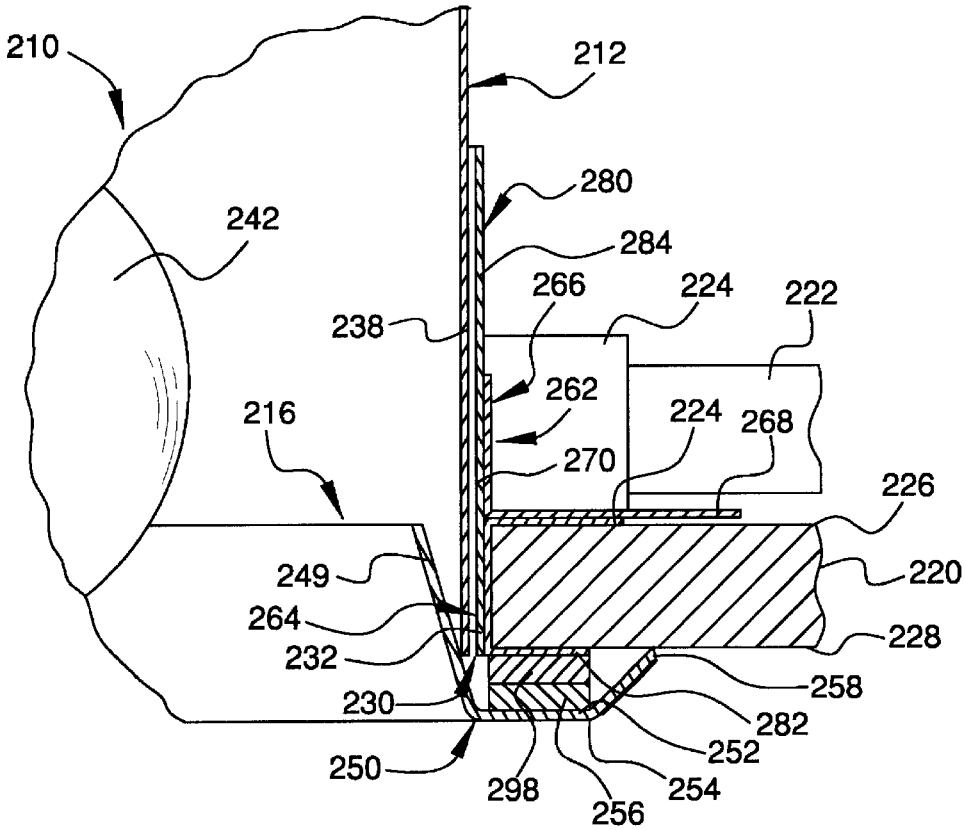
FIG. 11 is an enlarged, partial side elevational view in section of the lighting fixture illustrated in FIG. 10, showing a lamp enclosure of the lighting fixture mounted to a clamping member.

Embodiment of FIGS. 10–11

Referring to FIGS. 10–11, a lighting fixture 210 in accordance with a second embodiment of the present invention generally includes a lamp enclosure 212 that receives a lamp assembly 214 and is supported by a mounting member 216. Clamping members 218 mounted to a support structure 220, such as a ceiling, releasably engage mounting member 216, thereby supporting mounting member 216 and lamp enclosure 212 with respect to support structure 220. Clamping members 218 allow engagement of various configurations of lamp enclosure 212 via mounting member 216, so that any selected configuration of lamp enclosure 212 can be installed onto support structure 220. Also, because clamping members 218 releasably engage mounting member 216, mounting member 216 and lamp enclosure 212 can be easily removed from support structure 220 and replaced. Additionally, clamping members 218 are designed so that no tools are required to install mounting member 216 and lamp enclosure 212 onto support structure 220.

Lighting fixture 210 is similar to lighting fixture 10 and therefore only their differences will be described. As with fixture 10, hanger bars 222 and a plaster frame 224 can be used to provide support to lighting fixture 210 between two supports, such as joists 225, as seen in FIG. 10, in addition to the support provided by clamping members 218. However, hanger bars 222 and plaster frame 224 are not required because clamping members 218 alone can support fixture 210 with respect to support structure 220.

Support structure 220 includes a first or upper surface 226 and an opposite second or lower surface 228 with an opening 230 extending from upper surface 226 to lower surface 228. Opening 230 is sized to receive lighting fixture 210 and defines a perimeter surface 232 extending around an axis 234 extending through the center of opening 230, as seen in FIGS. 10 and 11. The terms "upper" and "lower" are used only to facilitate description of the claimed invention and do not limit the orientation of support structure 220 or lighting fixture 210.

Lamp enclosure 212 of lighting fixture 210 is a shield member, such as a standard can, and includes first and second end portions 236 and 238. Lamp assembly 214 is received within lamp enclosure 212, and includes a socket 240 with a lamp 242 having an end received in socket 240. Socket 240 is coupled to a sidewall 235 of lamp enclosure 212 by a socket bracket 237 with lamp 242 extending therefrom toward second end portion 238 of lamp enclosure 212. Also at sidewall 235 of lamp enclosure 212 is a thermal sensor 244 for detecting over heating and an inlet 246 for receiving wire conduit of an electrical connector 248 for providing power to lamp assembly 214. Second end portion 238 of lamp enclosure 212 is open to allow light from lamp 242 to radiate through and also allows replacement of lamp 212 from below support structure 220 through second end portion 238.

Mounting member 216 is formed separately from lamp enclosure 212 and includes a main body 249 and a radial mounting flange 250 extending therefrom. Main body 249 is sized to be received in second end portion 238 of lamp enclosure 212. Flange 250 has first and second opposing surfaces 252 and 254 with a fastener 256 disposed on first surface 252 in the form of a ring. A trim wall 258 extends outwardly from flange 250 at an angle, thereby forming an obtuse angle between trim wall 258 and first surface 252 of flange 250. Trim wall 258 can also extend from flange 250 at no angle.

Mounting member 216 supports lamp enclosure 212 in the same manner described above with respect to the engagement of shield member 102 and mounting member 16 of the first embodiment. Specifically, ears (not shown) of lamp enclosure 212 engage fastener 256 of mounting member 216.

Each clamping member 218 of lighting fixture 210, generally includes first and second parts 262 and 264 and each of which extend along an arc centered about an axis 234 for about 70 degrees. Clamping members 218 are the same as clamping members 18 and therefore will only be described briefly. Also, since clamping members 218 are the same, only one will be described. First part 262 includes a receiving portion 266 and a clamping portion 268 extending therefrom at a substantially ninety degree angle. Receiving portion 266 includes a wall 270 that has opposing U-shaped ends. A slot similar to slot 78 of clamping member 18 is defined between U-shaped ends and wall 270. Second part 264 of clamping member 218 includes a main portion 280 and a clamping portion 282 extending therefrom at a substantially ninety degree angle. Main portion 280 includes a wall 284.

A fastener 298 is disposed on clamping portion 282 of second part 264 for mating with fastener 256 of mounting member 216. Fasteners 256 and 298 are preferably made of hook and loop material. However, fasteners 256 and 298 can be any known attachment such as adhesive, snapping members, and the like. Also, although two clamping members 218 are shown, more than two or only one clamping member 218 can be employed.

The slot of receiving portion 266 of first part 262 slidably receives main portion 280, specifically wall 284, thereby defining a support receiving area between clamping portions 268 and 282 of each of first and second parts 262 and 264, respectively. As with the first embodiment, slot 278 and wall 284 are adapted to create a frictional engagement therebetween, thereby holding first and second parts 262 and 264 in engagement.

Assembly of Embodiment of FIGS. 10–11

In general, assembly and installation of lighting fixture 210 requires mounting clamping members 218 to support structure 220 and coupling mounting member 216, which supports lamp enclosure 212, with clamping members 218.

Initially, lamp enclosure 212 is mounted to mounting member 216 by the ears of lamp enclosure 212 engaging fastener 256 of mounting member 216. Since fastener 256 extends around mounting flange 250, ears of lamp enclosure 212 engage only a portion of fastener 256, leaving the unused portions for engagement with clamping members 218. Clamping members 18 are mounted to perimeter surface 232 of support structure opening 230 either before or after the assembly of lamp enclosure 212 and mounting member 216. Mounting of clamping members 218 to support structure 220 at opening 230 is accomplished in the same manner as described above with respect to clamping members 18 of the first embodiment, and therefore will not be described.

Once clamping members 218 are mounted to support structure 220, the assembly of lamp enclosure 212 and mounting member 216 with socket 240 secured to lamp enclosure wall 235, is inserted through opening 230 until fastener 256 of mounting member 216 abuts and engages fastener 298 of clamping member 218 with the ears of lamp enclosure 212 circumferentially offset from the clamping members 218. Fastener 256 engages fastener 298 at a plane not toward the second or lower surface 228 of support structure 220, as best seen in FIG. 11. In other words, fastener 256 engages fastener 298 below support structure 220 and outside of opening 230. The term "below" is used only to describe the relative orientation of fastener 256 with respect to support structure 220 such that fastener 256 can be above or to the side of support structure 220. Additionally, because mounting flange 250 and trim wall 258 have a diameter larger than opening 230, mounting member 216 will abut lower surface 228 of support structure 220. Trim wall 258 covers the outer perimeter of opening 230 to provide an aesthetic trim to lighting fixture 210. The engagement of fasteners 256 and 298 supports lamp enclosure 212 with respect to support structure 220. Once lamp enclosure 212 is mounted, electrical connector 248 can then be connected to socket 240 through inlet 246 of lamp enclosure 212.

In this position, support structure 220 is received between clamping portions 268 and 282 of first and second clamping parts 262 and 264, respectively, with opening perimeter surface 232 abutting wall 284 of second part 64. Clamping portion 282 abuts lower surface 228 of support structure 220 with fastener 298 of clamping portion 282 extending from portion 282 opposite support structure 220 and engaging fastener 256 of mounting member 216.

As with the first embodiment, fastener 298 of clamping members 218 engages different, circumferentially offset portions of fastener 256 of mounting member 216 than that of the ears of lamp enclosure 212. For example, the engagement of mounting member fastener 256 and fastener 298 of each clamping member 218 can be located at 0-degrees and 180-degrees, respectively, of support structure opening 230 and the engagement of fastener 256 of mounting member 216 with each ear of lamp enclosure can be located at 90-degrees and 270-degrees, respectively, of opening 230.

While particular embodiments have been chosen to illustrate the invention, it will be understood by those skilled in the art that various changes and modifications can be made therein without departing from the scope of the invention as defined in the appended claims.

What is claimed is:

1. A clamping member for a lighting fixture, comprising:

a first part having a receiving portion and a first clamping portion extending therefrom, said first clamping portion having opposing first and second surfaces;

a second part, separable from said first part, having a main portion and a second clamping portion extending from said main portion, said second clamping portion having first and second opposing surfaces, said main portion being received in said receiving portion of said first part with at least a section of said main portion being substantially enclosed by said receiving portion forming a friction fit therebetween so that a support receiving area is defined between said second surface of said first clamping portion and said first surface of said second clamping portion; and a fastener is disposed on said second surface of said second clamping portion for engaging the lighting fixture.

2. A clamping member according to claim 1, wherein said receiving portion of said first part and said main portion of said second part define a longitudinal axis; and said first and second parts are curved about said longitudinal axis.

3. A clamping member for a lighting fixture, comprising:

a first part having a receiving portion and a first clamping portion extending therefrom, said receiving portion includes first and second U-shaped ends forming a slot, and said first clamping portion having opposing first and second surfaces;

a second part, separable from said first part, having a main portion and a second clamping portion extending from said main portion, said second clamping portion having first and second opposing surfaces, said main portion being slidably received in said slot of said receiving portion of said first part forming a friction fit therebetween so that a support receiving area is defined between said second surface of said first clamping portion and said first surface of said second clamping portion; and a fastener is disposed on said second surface of said second clamping portion for engaging the lighting fixture.

4. A clamping member for a lighting fixture, comprising:

a first part having a receiving portion and a first clamping portion extending therefrom, said first clamping portion having opposing first and second surfaces;

a second part, separable from said first part, having a main portion and a second clamping portion extending from said main portion, said second clamping portion having first and second opposing surfaces, said main portion being received in said receiving portion of said first part forming a friction fit therebetween so that a support receiving area is defined between said second surface of said first clamping portion and said first surface of said second clamping portion; and a hook and loop fastener is disposed on said second surface of said second clamping portion for engaging the lighting fixture.

5. A lighting fixture, comprising;

a support structure having opposing first and second surfaces;

a lamp enclosure receiving a lamp assembly;

a mounting member supporting said lamp enclosure and having a first fastener; and a clamping member engaging each of said support structure and said mounting member, respectively, said clamping member having first and second parts, said first part being located proximate said first surface of said support structure and said second part being located proximate said second surface of said support structure, and said second part including a second fastener releasably coupled to said first fastener of said mounting member with said second part being located between said support structure and said second fastener.

6. A lighting fixture according to claim 5, wherein said support structure has an opening extending between said first and second surfaces for receiving said lamp enclosure;

said opening having a central longitudinal axis; and said second fastener being located outside of said opening.

7. A lighting fixture according to claim 5, wherein said each of said first and second parts of said clamping member is curved about said central longitudinal axis to conform to the curvature of said opening of said support structure.

8. A lighting fixture according to claim 5, wherein said first part includes a receiving portion and a first clamping portion;

said second part includes a main portion and a second clamping portion, and said second fastener is located on said second clamping portion; and said main portion of said second part extends through said opening and is received in said receiving portion of said first part forming a friction fit therebetween.

9. A lighting fixture according to claim 8, wherein said first clamping portion of said first part abuts said first surface of said support structure; and said second clamping portion of said second part abuts said second surface of said support structure.

10. A lighting fixture according to claim 8, wherein said receiving portion includes first and second U-shaped ends forming a slot that slidably receives said main portion of said second part of said clamping member.

11. A lighting fixture according to claim 8, wherein said receiving portion of said first part and said main portion of said second part are substantially parallel; and said first and second clamping portions are substantially perpendicular to said receiving portion and said main portion, respectively.

12. A lighting fixture according to claim 5, wherein said lamp enclosure is one of a reflective member and a trim member having an end portion;

said mounting member includes a mounting flange that extends from said end portion so that said lamp enclosure and said mounting member form a unitary one-piece member.

13. A lighting fixture according to claim 12, wherein a shield member encloses said lamp enclosure; and said shield member includes a third fastener releasably coupled to said first fastener of said mounting flange.

14. A lighting fixture according to claim 5, wherein said lamp enclosure is a shield member having an end portion and a third fastener;

said mounting member is separable from said lamp enclosure and includes a main body and a mounting flange extending therefrom; and said first fastener is located on said flange and is releasably coupled to said third fastener of said shield member.

15. A lighting fixture according to claim 5, wherein said mounting member includes a radial mounting flange having a diameter wider than a diameter of the opening.

16. A lighting fixture according to claim 5, wherein said first and second fasteners are hook and loop fasteners.

17. A lighting fixture according to claim 5, wherein a first electrical connector is electrically connected to said lamp assembly;

a second electrical connector is electrically connected to a power source; and said second electrical connector is coupled to said first electrical connector, thereby providing power to said lamp assembly.

18. A method of mounting a lighting fixture to a support structure, the support structure having an opening with an outer perimeter and first and second opposing surfaces, comprising the steps of:

mounting a clamping member on the support structure at the opening of the support structure with a first part of the clamping member engaging the first surface of the support structure and a second part of the clamping member engaging the second surface; and coupling a mounting member with the second part of the clamping member at a plane not toward the second surface of the support structure and outside of the outer perimeter if the of the support structure, the mounting member supporting a lamp enclosure that receives a lamp assembly.

19. A method of mounting a lighting fixture to a support structure, the support structure having an opening and first and second opposing surfaces, comprising the steps of:

mounting a clamping member on the support structure at the opening of the support structure with a first part of the clamping member engaging the first surface of the support structure and the second part of the clamping member engaging the second surface;

coupling a mounting member with the second part of the clamping member at a plane not toward the second surface of the support structure, the mounting member supporting a lamp enclosure that receives a lamp assembly;

placing the first part of the clamping member on the first surface of the support structure, the first part having a receiving portion and a first clamping portion extending therefrom; and coupling the second part of the clamping member with the first part of the clamping member with the second part having a main portion and a second clamping portion extending therefrom, by inserting the main portion of the second part through the opening of the support structure and into the receiving portion of the first part with at least a section of said main portion being substantially enclosed by said receiving portion forming a friction fit therebetween.

20. A method of mounting a lighting fixture to a support structure, the support structure having an opening and first and second opposing surfaces, comprising the steps of:

mounting a clamping member on the support structure at the opening of the support structure with a first part of the clamping member engaging the first surface of the support structure and the second part of the clamping member engaging the second surface;

coupling a mounting member with the second part of the clamping member at a plane not toward the second surface of the support structure, the mounting member supporting a lamp enclosure that receives a lamp assembly; and coupling the second part of the clamping member with the first part of the clamping member before mounting the clamping member on the support structure, by inserting a main portion of the second part into a receiving portion of the first part with at least a section of said main portion being substantially enclosed by said receiving portion forming a friction fit therebetween.

21. A method according to claim 18, further comprising the step of:

inserting the lamp enclosure through the opening in the support structure prior to coupling the mounting member with the second part of the clamping portion.

22. A method according to claim 21, further comprising the step of:

coupling a shield member with the mounting member prior to inserting the lamp enclosure through the opening.

23. A method according to claim 21, further comprising the step of:

coupling the lamp enclosure with the mounting member prior to inserting the lamp enclosure through the opening.

* * * * *